US006382008B1

(12) United States Patent
Jaubert

(10) Patent No.: US 6,382,008 B1
(45) Date of Patent: May 7, 2002

(54) PROCESS AND APPLIANCE FOR CHECKING THE QUALITY OF FORMINGS EXECUTED BY A MACHINE FOR FORMING TUBE ENDS

(75) Inventor: Philippe Jaubert, Cologne (FR)

(73) Assignee: Financiere Robolix, Cologne (FR)

( * ) Notice: Subject to any disclaimer, the term of this patent is extended or adjusted under 35 U.S.C. 154(b) by 0 days.

(21) Appl. No.: 09/704,691

(22) Filed: Nov. 3, 2000

(30) Foreign Application Priority Data

Nov. 4, 1999 (FR) ..... 99 13832

(51) Int. Cl.[7] ..... B21C 51/00; B21D 55/00

(52) U.S. Cl. ..... 72/21.4; 72/19.8; 72/37; 72/370.01; 72/370.1

(58) Field of Search ..... 72/17.2, 20.1, 72/20.2, 21.1, 21.4, 21.5, 37, 354.6, 358, 361, 370.1, 370.11, 370.01, 370.03, 16.2, 16.3, 16.4, 17.1, 18.2, 18.9, 19.8; 700/174, 175

(56) References Cited

U.S. PATENT DOCUMENTS 3,078,906 A 2/1963 Fuchs et al.
4,202,191 A * 5/1980 Skinner ..... 72/3
4,317,354 A * 3/1982 Wisebaker ..... 72/361
4,505,144 A 3/1985 Sakuma et al.
4,581,912 A * 4/1986 Iritani et al. ..... 72/370.1
5,465,597 A * 11/1995 Bajraszewski et al. ..... 72/19.8
5,771,727 A * 6/1998 Stinnertz et al. ..... 72/21.4
5,956,987 A * 9/1999 Anthoine ..... 72/21.5

* cited by examiner

*Primary Examiner*—Ed Tolan
(74) *Attorney, Agent, or Firm*—Young & Thompson

(57) ABSTRACT

The invention concerns a process for checking the quality of formings executed by a machine for forming tube ends, according to which the forming machine is equipped with a force transducer (33) which is capable of measuring the reactive axial force exerted by the tube on the tool (9*a*) in a forming pass and, for each forming, in a preliminary learning phase, the maximum reactive axial force exerted by the tube on the tool (9*a*) is measured, the quality of the executed forming is verified in conventional manner and the value of the maximum reactive axial force obtained in a forming of a quality meeting the required conditions is recorded, then, in each forming pass, the maximum reactive axial force exerted by the tube on the tool (9*a*) is measured, the value of the said maximum axial force is compared with the recorded reference value and the forming is validated if the measured maximum axial force corresponds to the reference force with a predetermined tolerance.

13 Claims, 2 Drawing Sheets

Figure 1:
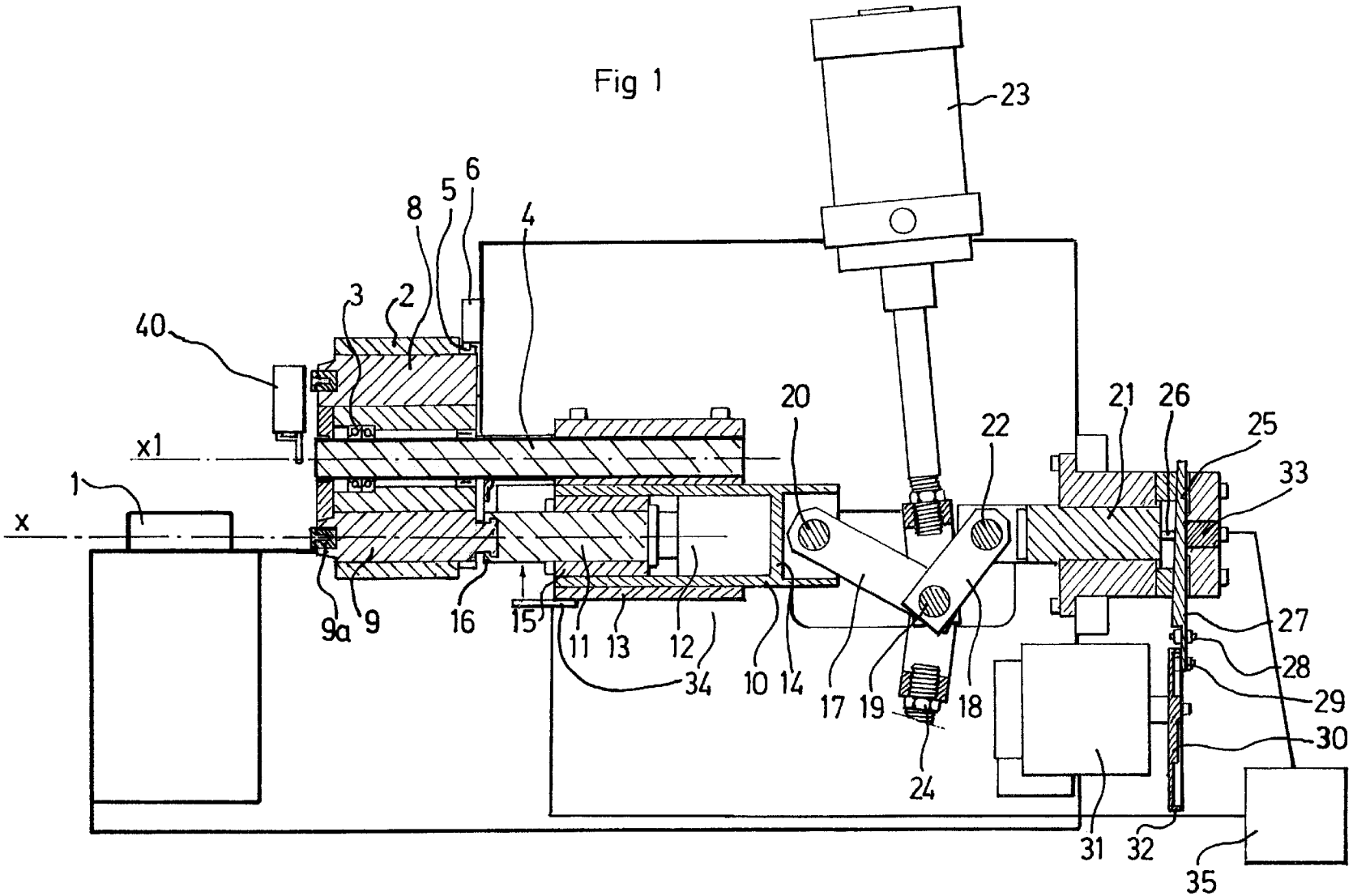

PROCESS AND APPLIANCE FOR CHECKING THE QUALITY OF FORMINGS EXECUTED BY A MACHINE FOR FORMING TUBE ENDS

The invention concerns a process and an appliance for checking the quality of formings executed by a machine for forming tube ends.

Machines for forming tube ends conventionally comprise means for holding a tube which are suitable for positioning it so that it extends on a longitudinal axis (x), called the forming axis, at least one tool for forming an end of the said tube, and means of translationally displacing each tool which are capable of displacing it on the axis (x), between an advanced forming position suitable for enabling the end of the tube to be formed and a retracted position suitable for allowing the unloading of the formed tube and the loading of a new tube.

The quality of the formings executed by such forming machines depends on a multitude of parameters, such as, in particular: the longitudinal positioning of the end of the tube, the wear of the forming tool, the thickness of the tube, the risk of rupturing of the tube, the hardness of the tube material, the possible absence of a component to be inserted on the end of the tube, the diameter of the tube, the advanced position of the tool, any slippage of the tubes in relation to the means of holding the latter, etc.

The fact of not taking account of any one of these parameters, or of experiencing a variation or absence of one of these parameters, results in a forming being obtained which is likely not to conform to the required conditions.

At the present time, the only solution which is aimed at rendering possible verification of the conformity of executed formings consists in sampling, by checking some tubes from each series of formed tubes. However, in consideration of the multiple parameters, mentioned above, which can alter the quality of the executed formings, it proves that these simple, limited checks do not enable the quality and conformity of all the tubes of a given series to be guaranteed. In practice, when use is made of the formed tubes, such checking by means of sampling proves to result in both a not insignificant wastage and numerous malfunctions resulting from a forming fault of the tubes formed thus.

The present invention seeks to overcome these disadvantages, its principal object being to provide a process for checking the quality of formings executed by a forming machine by which the conformity of formings to the required standards and conditions can be guaranteed.

To this end, the invention relates to a checking process according to which the forming machine is equipped with a force transducer which is capable of measuring the reactive axial force exerted by the tube on the tool in a forming pass and, for each forming:

- in a preliminary learning phase, the maximum reactive axial force exerted by the tube on the tool is measured, the quality of the executed forming is verified in conventional manner and the value of the maximum reactive axial force obtained in a forming of a quality meeting the required conditions is recorded,
- then, in each forming pass, the maximum reactive axial force exerted by the tube on the tool is measured, the value of the said maximum force is compared with the recorded reference value and the forming is validated if the measured maximum axial force corresponds to the reference force with a predetermined tolerance.

The origin of the invention was to ascertain that any variation of any one of the parameters capable of affecting the quality of formings executed by a forming machine systematically results in a variation of the maximum reactive axial force exerted by the tube on the tool. On the basis of this finding, which is not self-evident, the proposed solution according to the invention therefore consists in evaluating and recording, in a preliminary learning phase, the maximum reactive axial force exerted by the tube on the tool, then, in each forming pass, validating the executed forming if the maximum axial force measured in this forming corresponds to that recorded.

Such a process thus enables defective tubes to be detected when the tubes are formed, thereby making it possible to obtain and provide series of tubes of a quality which conforms to the required conditions.

For the purpose of perfecting the quality of the checks on the executed formings, the forming machine is also equipped, advantageously, with a linear displacement transducer which is capable of measuring the position of the tool and, for each forming pass:

- in the preliminary learning phase, the reactive axial force exerted by the tube on the tool in relation to the displacement of the said tool is measured, the quality of the executed forming is verified in conventional manner, and the development curve of the reactive axial force in relation to the displacement of the tool, obtained in a forming of a quality meeting the required conditions, is recorded,
- then, in each forming pass, a development curve of the reactive axial force in relation to the displacement of the tool is compiled, this curve is compared with the recorded reference curve, and the forming is validated if the two curves are identical with predetermined tolerances.

This advantageous approach results from the fact that it has been ascertained, not being self-evident, that not only the maximum reactive axial force exerted by the tube on the tool was characteristic of the executed forming, but also the development curve of the force exerted in relation to the positioning of the tool. Such an development curve of the exerted force constitutes a recordable signature which is capable of rendering possible better verification of the quality of the executed formings.

Again for the purpose of perfecting the quality of the checks on the executed formings, a checking station is advantageously added to the forming machine, comprising at least one computer-assisted camera which is suitable for viewing the formed ends of the tubes, then, for each forming:

- in a preliminary learning phase, the executed forming is viewed, the quality of the latter is verified in conventional manner, and the specific data inherent to the said forming is recorded, such as physical data, surface condition and design data, as well as to any operations preceding and/or succeeding the said forming, corresponding to a forming of a quality meeting the required conditions,
- then, in each forming pass, the executed forming is viewed, the data of the said forming is compared with the recorded reference data, and the forming is validated if the said data correspond with predetermined tolerances.

The addition of this viewing of the executed formings to the performance of the measures and comparisons described above is a means of guaranteeing the quality of the checks performed and, consequently, the total effectiveness of the checking process according to the invention. In addition, it not only permits validation of the executed forming, but also of any operations performed before and/or after the said forming, such as the fitting of a seal, nut, component, rolling operation, brushing operation, etc.

The following are non-exhaustive examples of defects which can be detected in this way:

cracks in the tubes poor pickling of the tubes defects resulting from the presence of slivers adhering to the forming tools components mounted the wrong way round defects resulting from scratches on the forming tools.

Furthermore, for the purpose of such viewing, advantageous use is made of at least one "CCD" type electronic scanning camera.

The invention includes a machine for forming tube ends, comprising means for holding a tube which are suitable for positioning it so that it extends on a longitudinal axis (x), at least one tool for forming an end of the said tube, and means of translationally displacing each tool which are capable of displacing it on the axis (x), between an advanced forming position suitable for enabling the end of the tube to be formed and a retracted position suitable for allowing the unloading of the formed tube and the loading of a new tube.

According to the invention, this forming machine comprises:

an axial force transducer capable of measuring the reactive axial force exerted by the tube on the tool, a programmable unit, connected to the force transducer and comprising means of recording the maximum reactive axial force obtained for given forming passes, and programmed to compare, for each forming pass, the maximum axial force obtained with the corresponding recorded reference force, and to provide information concerning the validation or otherwise of the forming according to the result of this comparison.

In addition, this forming machine advantageously comprises a linear displacement transducer capable of measuring the position of the tool, the programmable unit being connected to the said linear displacement transducer and to the force transducer and:

comprising means of recording development curves of the reactive axial forces in relation to the displacement of the tool, obtained for given forming passes, being programmed to compare, for each forming pass, the obtained development curve of the reactive axial force with the corresponding recorded reference development curve, and to provide information concerning the validation or otherwise of the forming according to the result of this comparison.

Furthermore, this forming machine is advantageously connected to a checking station comprising at least one camera which is positioned so as to view the end of each tube after forming of the latter, each of the said cameras being connected to a programmable unit equipped with means of recording specific data inherent to the different executed formings, such as physical data, surface condition and design data, as well as to any operations preceding and/or succeeding the forming, and programmed to compare, in each forming operation, the data obtained with the corresponding recorded reference data, and to provide information concerning the validation or otherwise of the forming according to the results of these comparisons.

Furthermore, each camera can be advantageously disposed so that it views the formed tube end axially.

It can also be advantageously disposed so that it views the formed tube end longitudinally.

In addition each camera is advantageously a "CCD" type electronic scanning camera.

Figure 2A:
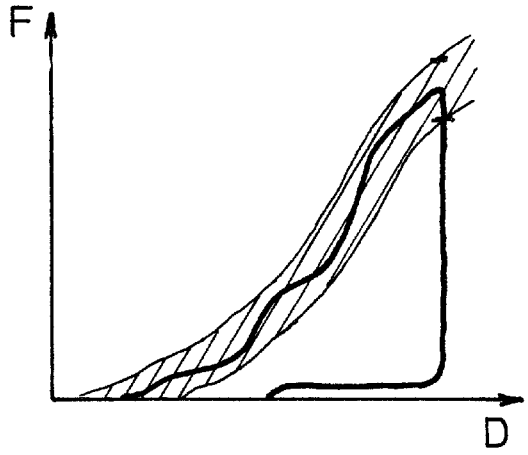
Figure 2B:
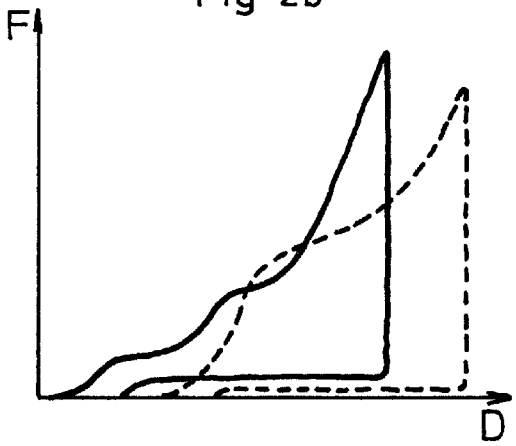
Figure 3:
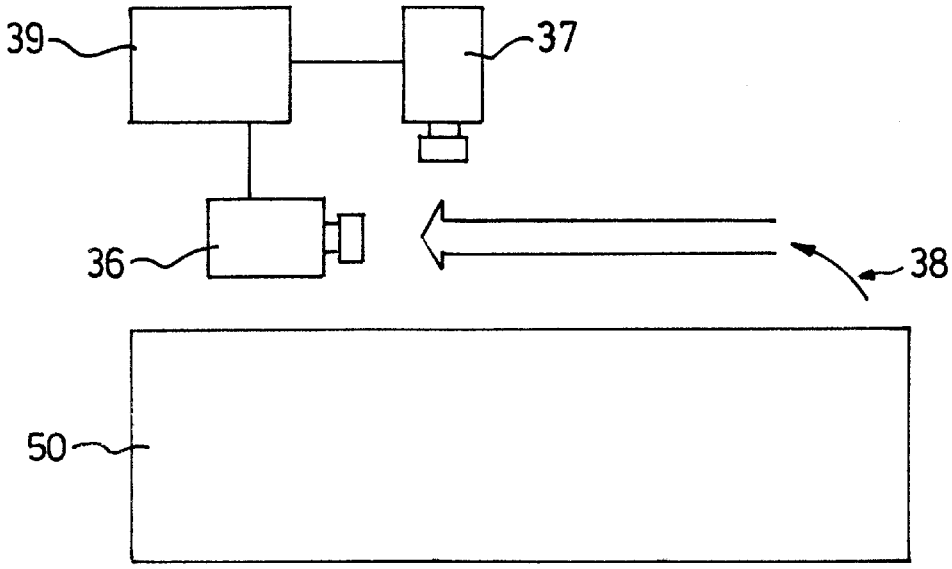

Other characteristics, objectives and advantages of the invention will be disclosed by the detailed description which follows with reference to the appended drawings, depicting by way of non-restrictive example a preferred embodiment of the invention, wherein:

FIG. 1 is a longitudinal, partially sectional view through an axial plane of a forming machine according to the invention, FIGS. 2*a* and 2*b* are curves, showing the development of the force in relation to the displacements of the tool, obtained, respectively, for a forming executed in a single pass and a forming executed in two successive passes, and FIG. 3 is a schematic plane view of a forming installation comprising a forming machine as depicted in FIG. 1.

The forming machine depicted by way of example in FIG. 1 is suitable for forming the end of tubes that are presented axially, on a forming axis (x), opposite forming tools and held clamped for the purpose of the forming operation between two clamping jaws such as 1.

Such clamping jaws 1, actuated between an open position for loading and unloading of the tubes and a closed position for clamping and holding the said tubes, can be of any conventional, per se known type, or preferably of the type of those described in the patent application filed jointly with the present application this day on behalf of the applicant.

Apart from these two clamping jaws 1, the forming machine according to the invention comprises, firstly, a tool holder support barrel 2, mounted so as to be rotatable about an axis of rotation (x1) parallel to the forming axis (x).

This barrel 2 is mounted so that it is rotatable, by means of rolling bearings such as 3, about the anterior segment of a shaft 4 centred on the axis (x1), and is attached in a translationally rigid manner to the said shaft. In addition, this barrel 2 is perforated, in conventional manner, by a plurality of cylindrical, longitudinal receiving cavities uniformly distributed around the axis (x1) and separated from the latter by an equal distance suitable for enabling each receiving cavity to be presented coaxially with the forming axis (x) by rotation of the said barrel.

Finally, the barrel 2 has a peripheral wall with a posterior end segment 5, machined in the form of a toothed wheel, suitable for engaging with a pinion 6 located above the upper generating line of the said barrel, and mounted on the motor shaft of a brushless motor (not depicted) suitable for enabling the position of the various receiving cavities to be indexed in relation to the forming axis (x).

The forming machine also comprises a set of cylindrically shaped tool holders such as 8, 9, suitable for insertion by sliding in the receiving cavities of the barrel 2 and having a blind bore in which a tool such as 9*a* is inserted and rigidly attached in conventional manner.

This forming machine also comprises a pusher unit of the tool holder 9, positioned on the forming axis, and means of translationally displacing the said pusher unit.

Firstly, the pusher unit is composed principally of three components which form a unit comprising two telescopic elements 10, 11, and a force limiting component 12, inserted between the said elements and calibrated so that it is released and compressed only beyond a predetermined force threshold exerted on the said pusher unit.

The first of the telescopic elements 10, called the posterior pusher, consists of a hollow cylinder mounted so as to be capable of sliding translationally within a translational guide bearing 13 centred on the forming axis (x) and rigidly attached under the generating line of the shaft 4. In addition, this posterior pusher 10 comprises an internal transverse separating wall 14, located at a short distance from its posterior end.

As for the force limiting component 12, it consists of a prestressed gas spring accommodated in the posterior pusher 10 in such a way that it comes to bear against the anterior face of the separating wall 14 of the latter.

The second of the telescopic elements 11, called the anterior pusher, consists of a solid cylindrical pusher, partially accommodated in the posterior pusher 10, in a translational guide bearing 15 disposed in this posterior pusher 10, in such a way that the said anterior pusher is stopped against the prestressed gas spring 12.

This anterior pusher 11 additionally comprises, at its anterior face, means of attachment 16 capable of enabling it to be rigidly attached to the tool holder 9 positioned on the forming axis.

As for the means of translationally displacing this pusher unit, they comprise, firstly, two links 17, 18 articulated in relation to one another about a central hinge pin 19:

a first anterior link 17, articulated at its opposite end on the posterior pusher 10 at a front hinge in 20 which is coaxial with the forming axis, a second posterior link 18, articulated at its opposite end on a slide 21 mounted in a guide bore recessed in the supporting structure of the forming machine, at a rear hinge pin 22 which is coaxial with the forming axis.

These means of translational displacement additionally comprise two actuating cylinders 23, 24, for actuating the links 17, 18, which are disposed and powered in opposition and whose rods are articulated on the central hinge pin 19 of the said links.

Finally, the means of translational displacement comprise means of adjusting, over a travel of the order of 2 mm, the advanced position of the pusher unit and, consequently, of the tool holder 9 actuated by the latter.

These means of adjustment comprise, firstly, a shim 25, of trapezoidal section, accommodated in a vertical slideway recessed in the supporting structure at the rear of the slide 21, the said shim having an anterior face which is inclined in relation to the vertical and suitable for contacting the posterior face of the said slide by means of a ball/spring system, depicted schematically as 26.

These means of adjustment additionally comprise means of translationally displacing the shim 25 which are capable of displacing it vertically in its slideway so as to adjust the longitudinal position, on the forming axis, of the slide 21.

These means of displacement comprise a cam 27, constituted by the lower projection of the shim 25, at the lower end of which are mounted two superposed rollers 28, 29 having axes of rotation which are parallel to the forming axis.

These means of displacement additionally comprise a disc 30 mounted eccentrically on the shaft of a motor 31 for rotationally driving this disc, the said disc having a peripheral rim 32 and being disposed in such a manner that the rollers 28, 29 come into contact with the peripheral rim 32 on either side of the latter, at the upper generating line of the disc.

The forming machine according to the invention additionally comprises a stop 40, which is retractable on an axis orthogonal to the forming axis (x), for positioning the end of tubes prior to forming of the latter.

The forming machine according to the invention furthermore comprises a strain gauge type axial force transducer 33 suitable for measuring the reactive axial force exerted by the tube on the tool 9*a*. In the example, this axial force transducer 33 is disposed in contact with the posterior face of the shim 25 and thus renders possible measurement of the force exerted on the latter in the displacement of the tool 9*a* towards its advanced forming position, the said measured force representing the reactive force exerted by the tube on the said tool.

The forming machine additionally comprises an incremental rule type linear displacement transducer 34 which is capable of measuring the displacement value of the tool holder 9. In the example, this linear displacement transducer 34 is positioned so as to read the displacement of the anterior pusher 11.

The two aforementioned transducers 33, 34 are connected to a programmable unit 35:

comprising means of recording development curves of the reactive axial forces in relation to the displacement of the tool holder 9, obtained for given forming passes, programmed to compare, for each forming pass, the obtained development curve of the reactive axial force with the corresponding recorded reference development curve, and to provide information concerning the validation or otherwise of the forming according to the result of this comparison.

FIGS. 2*a* and 2*b* show, by way of example, such development curves obtained, respectively, in a forming executed in a single forming pass (FIG. 2*a*) and in a forming executed in two successive forming passes (FIG. 2*b*). Also shown in FIG. 2*a* are the envelope curves which determine the tolerance range on either side of the optimal development curve, within which a forming is validated as being satisfactory.

By means of the preliminary learning phases, the purpose of which is to render possible the recording, for each type of forming, of the development curve of the force in relation to the displacement of the tool 9*a* obtained in a forming of satisfactory quality, such a checking facility renders possible checking of the quality of each executed forming and, consequently, a systematic elimination of formed tubes which do not conform to the requirements.

Finally, as depicted schematically in FIG. 3, the forming machine 50 according to the invention is advantageously connected to a checking station towards which the formed tubes are brought by a transfer unit 38, and comprising two "CCD" type electronic scanning cameras 36, 37 positioned for axial and longitudinal viewing, respectively, of the end of each tube after forming of the latter.

These cameras 36, 37 are additionally connected to a programmable unit 39 equipped with means of recording the specific data inherent to the different executed formings, such as physical data, surface condition and design data, as well as to any operations preceding and/or succeeding the said forming, and programmed to compare, in each forming operation, the data obtained with the corresponding recorded reference data, and to provide information concerning the validation or otherwise of the forming according to the results of these comparisons.

The use of such cameras 36, 37 is a means of providing a second type of check on the executed formings which, combined with the first check mentioned above, is a means of providing a global checking process allowing detection of any forming defect and any defect resulting from any operations performed before and/or after the said forming.

What is claimed is:

1. Process for checking the quality of formings executed by a machine for forming tube ends, comprising means (1) for holding a tube which are suitable for positioning it so that it extends on a longitudinal axis (x), called the forming axis, at least one tool (9*a*) for forming an end of the said tube, and means (10–24) of translationally displacing each tool (9*a*) which are capable of displacing it on the axis (x), between an advanced forming position suitable for enabling the end of the tube to be formed and a retracted position suitable for allowing the unloading of the formed tube and the loading of a new tube, the said process being characterized in that the forming machine is equipped with a force transducer (33) which is capable of measuring the reactive axial force exerted by the tube on the tool **(9*a*)** in a forming pass and, for each forming:

in a preliminary learning phase, the maximum reactive axial force exerted by the tube on the tool **(9*a*) is measured, the quality of the executed forming is verified in conventional manner and the value of the maximum reactive axial force obtained in a forming of a quality meeting the required conditions is recorded, then, in each forming pass, the maximum reactive axial force exerted by the tube on the tool (9*a*)** is measured, the value of the said maximum axial force is compared with the recorded reference value and the forming is validated if the measured maximum axial force corresponds to the reference force with a predetermined tolerance.

2. Checking process according to claim 1, characterized in that the forming machine is equipped with a linear displacement transducer (34) which is capable of measuring the position of the tool **(9*a*)** and, for each forming pass:

in the preliminary learning phase, the reactive axial force exerted by the tube on the tool **(9*a*) in relation to the displacement of the said tool is measured, the quality of the executed forming is verified in conventional manner, and the development curve of the reactive axial force in relation to the displacement of the tool (9*a*), obtained in a forming of a quality meeting the required conditions, is recorded, then, in each forming pass, a development curve of the reactive axial force in relation to the displacement of the tool (9*a*)** is compiled, this curve is compared with the recorded reference curve, and the forming is validated if the two curves are identical with predetermined tolerances.

3. Checking process according to claim 1, characterized in that a checking station is added to the forming machine (50), comprising at least one camera (36, 37), assisted by computer (39), which is suitable for viewing the formed ends of the tubes, then, for each forming:

in a preliminary learning phase, the executed forming is viewed, the quality of the latter is verified in conventional manner, and the specific data inherent to the said forming is recorded, such as physical data, surface condition and design data, as well as to any operations preceding and/or succeeding the said forming, corresponding to a forming of a quality meeting the required conditions, then, in each forming pass, the executed forming is viewed, the data of the said forming is compared with the recorded reference data, and the forming is validated if the said data correspond with predetermined tolerances.

4. Checking process according to claim 3, characterized in that at least one "CCD" type electronic scanning camera (36, 37) is used.

5. Machine for forming tube ends, comprising means (1) for holding a tube which are suitable for positioning it so that it extends on a longitudinal axis (x), at least one tool **(9*a*) for forming an end of the said tube, and means (10–24) of translationally displacing each tool (9*a*)** which are capable of displacing it on the axis (x), between an advanced forming position suitable for enabling the end of the tube to be formed and a retracted position suitable for allowing the unloading of the formed tube and the loading of a new tube, the said forming machine being characterized in that it comprises:

an axial force transducer (33) capable of measuring the reactive axial force exerted by the tube on the tool **(9*a*), a programmable unit (35), connected to the axial force transducer (33)** and comprising means of recording the maximum reactive axial force obtained for given forming passes, and programmed to compare, for each forming pass, the maximum axial force obtained with the corresponding recorded reference force, and to provide information concerning the validation or otherwise of the forming according to the result of this comparison.

6. Forming machine according to claim 5, characterized in that it comprises a linear displacement transducer (34) capable of measuring the position of the tool **(9*a*), the programmable unit (35) being connected to the said linear displacement transducer and to the force transducer (33)** and:

comprising means of recording development curves of the reactive axial forces in relation to the displacement of the tool, obtained for given forming passes, being programmed to compare, for each forming pass, the obtained development curve of the reactive axial force with the corresponding recorded reference development curve, and to provide information concerning the validation or otherwise of the forming according to the result of this comparison.

7. Forming machine according to claim 6, characterized in that it is connected to a checking station comprising at least one camera (36, 37) which is positioned so as to view the end of each tube after forming of the latter, each of the said cameras being connected to a programmable unit (39) equipped with means of recording specific data inherent to the different executed formings, such as physical data, surface condition and design data, as well as to any operations preceding and/or succeeding the forming, and programmed to compare, in each forming operation, the data obtained with the corresponding recorded reference data, and to provide information concerning the validation or otherwise of the forming according to the results of these comparisons.

8. Forming machine according to claim 5, characterized in that it is connected to a checking station comprising at least one camera (36, 37) which is positioned so as to view the end of each tube after forming of the latter, each of the said cameras being connected to a programmable unit (39) equipped with means of recording specific data inherent to the different executed formings, such as physical data, surface condition and design data, as well as to any operations preceding and/or succeeding the forming, and programmed to compare, in each forming operation, the data obtained with the corresponding recorded reference data, and to provide information concerning the validation orotherwise of the forming according to the results of these comparisons.

9. Forming machine according to claim 8, characterized in that the checking station comprises a camera (36) disposed so that it views the formed tube end axially.

10. Forming machine according to claim 9, characterized in that each camera (36, 37) is a "CCD" type electronic scanning camera.

11. Forming machine according to claim 9, characterized in that each camera (36, 37) is a "CCD" type electronic scanning camera.

12. Forming machine according to claim 8, characterized in that the checking station comprises a camera (37) disposed so that it views the formed tube end longitudinally.

13. Forming machine according to claim 8, characterized in that each camera (36, 37) is a "CCD" type electronic scanning camera.

* * * * *